US008928213B2

(12) United States Patent
Murayama

(10) Patent No.: US 8,928,213 B2
(45) Date of Patent: Jan. 6, 2015

(54) SPARK PLUG FOR INTERNAL-COMBUSTION ENGINE

(71) Applicant: Denso Corporation, Kariya, Aichi-pref. (JP)

(72) Inventor: Yuki Murayama, Toyoake (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 14/300,624

(22) Filed: Jun. 10, 2014

(65) Prior Publication Data

US 2014/0361678 A1 Dec. 11, 2014

(30) Foreign Application Priority Data

Jun. 10, 2013 (JP) ..... 2013-121711

(51) Int. Cl.
*H01T 21/02* (2006.01)
*H01T 13/02* (2006.01)
*H01T 13/20* (2006.01)

(52) U.S. Cl.
CPC ..... *H01T 13/20* (2013.01)
USPC ..... 313/141; 313/142; 313/143

(58) Field of Classification Search
USPC ..... 313/118–145, 169 R, 169 EL; 123/32, 123/41, 310
See application file for complete search history.

(56) References Cited

U.S. PATENT DOCUMENTS

| | | | | |
|---|---|---|---|---|
| 8,476,815 | B2 * | 7/2013 | Kato | 313/141 |
| 2005/0067933 | A1 | 3/2005 | Kato | |
| 2008/0092838 | A1 * | 4/2008 | Takeuchi et al. | 123/169 R |
| 2008/0092839 | A1 * | 4/2008 | Hanashi et al. | 123/169 R |

FOREIGN PATENT DOCUMENTS

| | | |
|---|---|---|
| JP | 2005-123181 | 5/2005 |

* cited by examiner

*Primary Examiner* — Tracie Y Green
(74) *Attorney, Agent, or Firm* — Nixon & Vanderhye PC

(57) ABSTRACT

A spark plug for an internal-combustion engine. The spark plug includes a central electrode, an insulator that holds the central electrode inside, a housing that holds the insulator inside, a ground electrode that forms a spark gap with the central electrode. The ground electrode includes a ground base member connected to the housing, and a ground protrusion protruding from a confronting face of the ground base member confronting the central electrode. The ground protrusion has a diameter of 0.9 to 1.4 mm. The spark plug is configured to satisfy $\theta \geq -53R+49$, where R [mm] is a curvature radius of a base member corner and θ[degrees] is an angle formed by a shortest connecting line between the base member corner and a protrusion corner and a plane perpendicular to an axial direction of the ground protrusion.

11 Claims, 4 Drawing Sheets

SPARK PLUG FOR INTERNAL-COMBUSTION ENGINE

CROSS-REFERENCE TO RELATED APPLICATION

This application is based on and claims the benefit of priority from earlier Japanese Patent Application No. 2013-121711 filed Jun. 10, 2013, the description of which is incorporated herein by reference.

BACKGROUND

1. Technical Field

The present invention relates to a spark plug for an internal-combustion engine.

2. Related Art

A spark plug, which provides an ignition means for an automobile engine or the like, includes a spark gap between a central electrode and a ground electrode confronted with each other. Application of a pulsed voltage between the central electrode and the ground electrode generates a discharge.

There is known such a spark plug that a noble metal tip is joined to each of the central electrode and the ground electrode. As an outer diameter of either or both of these noble metal tips decreases, the ignitability increases, whilst the attrition resistance decreases. In addition, as a protrusion of the ground electrode side noble metal tip increases, the ignitability increases, while leading ends of the noble metal tips become hot, thereby reducing the attrition resistance.

To improve the attrition resistance of the noble metal tips while ensuring the ignitability, techniques as disclosed in Japanese Patent Application Laid-Open Publication No. 2005-123181 use noble metal tip materials that have high temperature oxidation resistance to satisfy a predetermined condition.

However, the disclosed techniques have limited choices in noble metal tip materials, which may lead to an expensive spark plug.

In recent years, there is a trend for a flow rate of an air stream, such as a tumble flow, in a combustion chamber to get higher as an internal-combustion engine is scaled to high powers and lean combustions. A discharge spark generated between the central electrode and the ground electrode is prone to be blown out at a higher flow rate of the air stream in the combustion chamber, which leads to a higher frequency of re-discharge. This leads to an increased amount of wear of the central electrode and the ground electrode (hereinafter merely referred to as electrodes).

The blowing out of the discharge spark generated between the central electrode and the ground electrode may be caused by migration of a ground electrode side root of the discharge spark to a ground base member corner, which migration is caused by the air stream in the combustion chamber. That is, the discharge spark is stretched by a mixed fuel-air stream in the combustion chamber and is electrically attracted to the ground base member corner which has high field intensity. This may cause the migration of the ground electrode side root of the discharge spark from a ground protrusion to the ground base member corner. The discharge spark is stretched in a direction such that the air stream is not interrupted by the ground electrode. That is, the discharge spark is stretched in a widthwise direction of a confronting face of the ground base member that confronts the central electrode.

Such migration of the ground electrode side root of the discharge spark to the ground base member corner (referred to as "root migration(s) of discharge spark(s)") may lead to a higher frequency of re-discharges and thus to an increased amount of wear of the electrodes.

In consideration of the foregoing, exemplary embodiments of the present invention are directed to providing a spark plug capable of preventing the root migrations of discharge sparks and thereby reducing electrode wear.

SUMMARY

In accordance with an exemplary embodiment of the present invention, there is provided a spark plug for an internal-combustion engine. The spark plug includes: a central electrode; an insulator that holds the central electrode inside; a housing that holds the insulator inside; a ground electrode that forms a spark gap with the central electrode. The ground electrode includes a ground base member connected to the housing, and a ground protrusion protruding from a confronting face of the ground base member confronting the central electrode. The ground protrusion has a diameter of 0.9 to 1.4 mm. The spark plug is configured to satisfy the following inequality: $\theta \geq -53R+49$, where R [mm] is a curvature radius of a base member corner and θ[degrees] is an angle formed by a shortest connecting line between the base member corner and a protrusion corner and a plane perpendicular to an axial direction of the ground protrusion. The base member corner is a widthwise directional edge of the confronting face of the ground base member and the protrusion corner is an edge of a spark face of the ground protrusion confronting the central electrode.

As above, the spark plug is configured such that the angle θ and the curvature radius R satisfy the inequality $\theta \geq -53R+49$. This can prevent root migrations of discharge sparks even as the air flow rate in the combustion chamber increases with the spark plug being attached to the internal-combustion engine.

That is, a larger angle θ can prevent the discharge spark stretched by a mixed fuel-air stream in a combustion chamber from approaching too close to the base member corner. Hence the discharge spark is less frequently attracted to the base member corner, which can more reliably prevent the root migrations of discharge sparks.

In addition, a larger curvature radius R can reduce the intensity of electrical fields around the base member corner to a greater extent. This can reduce attractive forces that electrically attract the discharge spark to the base member corner, which can facilitate preventing the root migrations of discharge sparks.

The ground protrusion has a diameter of 0.9 to 1.4 mm, which can ensure the attrition resistance of the ground protrusion and can sufficiently prevent the root migrations of discharge sparks. That is, the diameter of the ground protrusion is set equal to or greater than 0.9 mm, which can ensure the attrition resistance of the ground protrusion. Meanwhile, the diameter of the ground protrusion is set equal to or less than 1.4 mm, which can prevent the root migrations of discharge sparks.

The specific cross-sectional shape of the ground electrode as defined above can restrain wearing of the ground electrode, which can facilitate ensuring various choices in materials of the ground protrusion without limitation to specific materials and can restrain the cost rise.

Thus, the spark plug configured as above can provide an advantage that preventing the root migrations of discharge sparks allows the electrode wear to be restrained.

DESCRIPTION OF SPECIFIC EMBODIMENTS

The present inventions will be described more fully hereinafter with reference to the accompanying drawings. Like numbers refer to like elements throughout.

First Embodiment

A spark plug for an internal-combustion engine in accordance with a first embodiment of the present invention will now be explained with reference to FIGS. 1 to 3.

Figure 1:
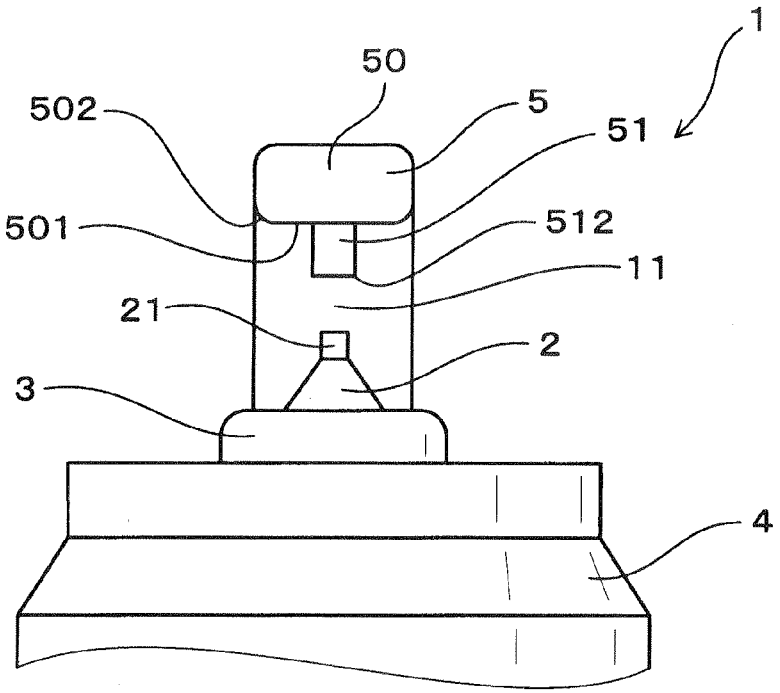
FIG. 1 is a front view of features adjacent a tip of a spark plug in accordance with a first embodiment of the present invention.
Figure 2:
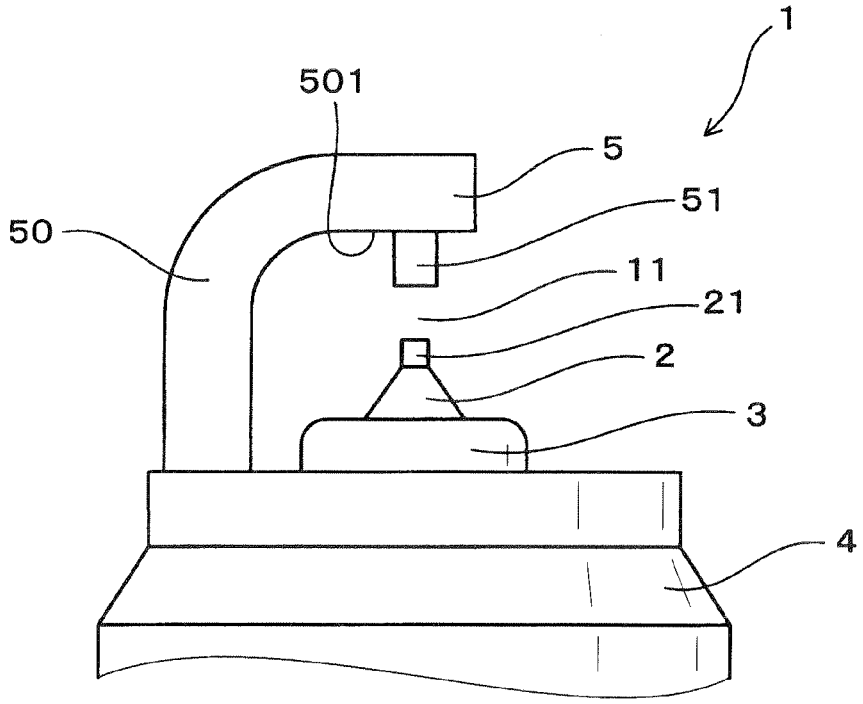
FIG. 2 is a side view of features adjacent the tip of the spark plug of the first embodiment.

As shown in FIGS. 1 and 2, the spark plug 1 includes a central electrode 2, an insulator 3 that holds the central electrode 2 inside, a housing 4 that holds the insulator 3 inside, and a ground electrode 5 that forms a spark gap 11 with the central electrode 2.

The ground electrode 5 includes a ground base member 50 connected to the housing 4, and a ground protrusion 51 protruding from a confronting face 501 of the ground base member 50 confronting the central electrode 2.

Figure 3:
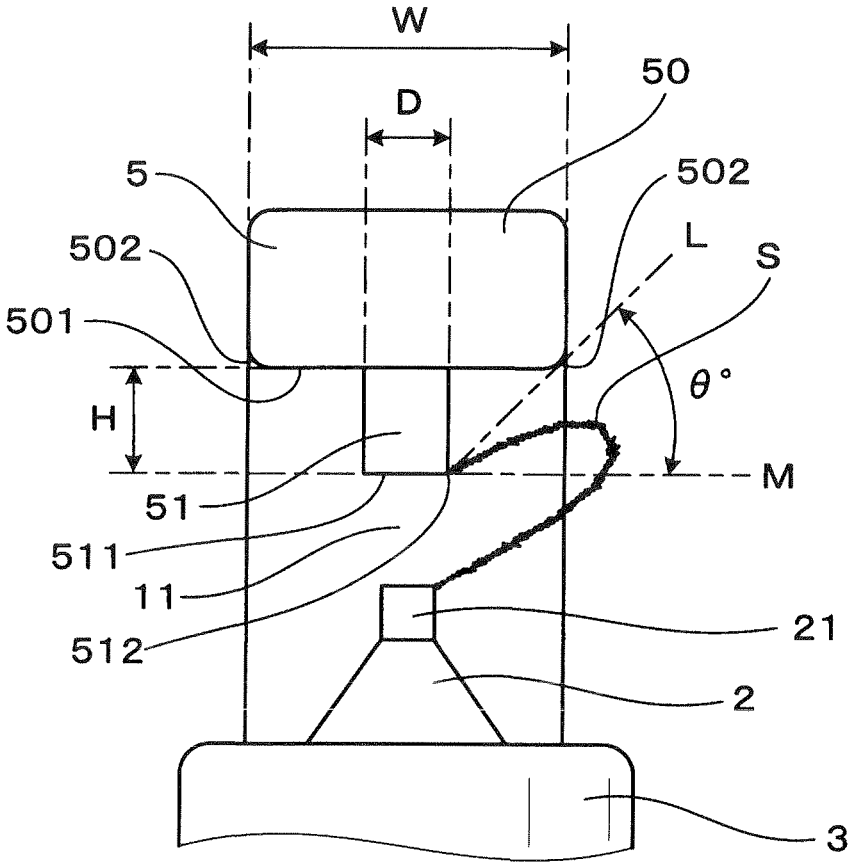
FIG. 3 is a front view of features adjacent a spark gap of the spark plug of the first embodiment.

FIG. 3 shows features adjacent the spark gap 11 of the spark plug 1.

The ground protrusion 51 has a diameter D of 0.9 to 1.4 mm.

The spark plug 1 is configured to satisfy the following relational expression between a curvature radius R of a base member corner 502 and an angle θ[degrees] as defined later:

$$\theta \geq -53R+49 \quad (1)$$

The angle θ[degrees] is formed by a shortest connecting line between a protrusion corner 512 and a base member corner 502 and a plane M perpendicular to an axial direction of the ground protrusion 51, where the protrusion corner 512 is an edge of a spark face 511 of the ground protrusion 51 confronting the central electrode 2 and the base member corner 502 is a widthwise directional edge of the confronting face 501 of the ground base member 50. Preferably, the curvature radius R of the base member corner 502 and the angle θ[degrees] defined as above the following relational expression:

$$\theta \geq -59R+62 \quad (2)$$

The ground protrusion 51 has a protrusion height H of 0.6 to 1.2 mm from the ground base member 50. The ground base member 50 has a widthwise dimension W of 2.4 to 3.0 mm in a widthwise direction that is perpendicular both to a longitudinal direction of the ground base member 50 and to an axial direction of the ground protrusion 51. The curvature radius R of the base member corner 502 is 0.1 to 0.4 mm.

In the present embodiment, as shown in FIGS. 1 and 3, the ground base member 50 has a substantially rectangular cross-section and is chamfered to be curved at the four corners including the base member corners 502. In addition, as shown in FIG. 2, the ground base member 50 is formed of a nickel alloy rod such that one end portion of the rod is bonded to an apical face of the housing 4 and the other end portion is bent towards the center axis of the spark plug 1. One of principal faces of the ground base member 50 that confronts the central electrode 2 is the confronting face 501. A widthwise directional edge of the confronting face 501 of the ground base member 50 is the edge 502 of the ground base member 50, where the widthwise direction of the confronting face 501 is perpendicular both to the longitudinal direction of the ground base member 50 and to the axial direction of the ground protrusion 51.

The ground protrusion 51 is formed of a noble metal tip bonded to the confronting face 501 of the ground base member 50. The ground protrusion 51 (noble metal tip) is cylindrical in shape and made from noble metal, such as platinum-alloys, iridium alloys and the like. The cylindrical noble metal tip is bonded to the confronting face 501 of the ground base member 50 at one of bottoms faces of the cylindrical tip by welding or the like, thereby forming the ground protrusion 51. The other bottom face is defined as the spark face 511 of the ground protrusion 51. The ground protrusion 51 is bonded to the ground base member 50 in its widthwise directional center.

The central electrode 2 includes a tip that is also cylindrical in shape and made from noble metal, such as platinum-alloys, iridium alloys and the like. The noble metal tip 21 of the central electrode 2 and the ground protrusion 51 are axially aligned with each other such that the spark gap 11 is formed between the noble metal tip 21 of the central electrode 2 and the ground protrusion 51 of the ground electrode 5.

Some advantages of the present embodiment will now be explained.

The spark plug 1 is configured such that the angle θ and the curvature radius R satisfy the following relational expression (inequality): $\theta \geq -53R+49$. This can prevent occurrence of the root migrations of discharge sparks even as the air flow rate in the combustion chamber increases with the spark plug 1 being attached to the internal-combustion engine (as described latter). Preferably, the spark plug 1 may be configured to satisfy the following relational expression (inequality): $\theta \geq -59R+62$, which can more effectively prevent occurrence of the root migrations of discharge sparks.

That is, as shown in FIG. 3, a larger angle θ can more advantageously prevent the discharge spark S stretched by the mixed fuel-air stream in the combustion chamber from approaching too close to the base member corner 502. Hence the discharge spark S is less frequently attracted to the base member corner 502, which can more reliably prevent occurrence of the root migrations of discharge sparks. In addition, a larger curvature radius R can reduce the intensity of electrical fields around the base member corner 502 to a greater extent. This can reduce attractive forces that electrically attract the discharge spark S to the base member corner 502, which can facilitate preventing the root migrations of discharge sparks.

The ground protrusion 51 has a diameter D of 0.9 to 1.4 mm, which can ensure the attrition resistance of the ground protrusion 51 and can reliably prevent the root migrations of discharge sparks. That is, the diameter D of the ground protrusion 51 is set equal to or greater than 0.9 mm, which can ensure the attrition resistance of the ground protrusion 51. Meanwhile, the diameter D of the ground protrusion 51 is set equal to or less than 1.4 mm, which can prevent the root migrations of discharge sparks.

The ground protrusion 51 has a protrusion height of 0.6 to 1.2 mm, which can ensure the attrition resistance while advantageously preventing the root migrations of discharge sparks. That is, the protrusion height H of the ground protrusion 51 is set equal to or greater than 0.6 mm, which can facilitate increasing the angle θ and can prevent the discharge sparks from approaching too close to the base member corner 502. Meanwhile, the protrusion height H of the ground protrusion 51 is set equal to or less than 1.2 mm, which can prevent wearing of the ground protrusion 51.

The ground base member 50 has a widthwise dimension W of 2.4 to 3.0 mm, which can more reliably prevent the root migrations of discharge sparks while ensuring the strength of the ground base member 50. That is, the widthwise dimension W of the ground base member 50 is set equal to greater than 2.4 mm, which can ensure sufficient strength of the ground base member 50. Meanwhile, the widthwise dimension W of the ground base member 50 is set equal to less than 3.0 mm, which can facilitate increasing the angle θ and can prevent the discharge sparks from approaching too close to the base member corner 502.

The base member corner 502 has a curvature radius R of 0.1 to 0.4 mm, which can effectively prevent the root migrations of discharge sparks while ensuring the attrition resistance of the ground electrode 5. That is, the curvature radius R of the base member corner 502 is set equal to greater than 0.1 mm, which can prevent the intensity of electrical fields around the base member corner 502 from increasing too high and can facilitate preventing the root migrations of discharge sparks. Meanwhile, the curvature radius R of the base member corner 502 is set equal to less than 0.4 mm, which can facilitate ensuring a cross-sectional area of the cross-section perpendicular to the axial direction of the ground base member 50. This can prevent the temperature rise of the ground electrode 5, thereby ensuring the attrition resistance of the ground electrode 5.

The specific shape of the ground electrode 5 as defined above can restrain wearing of the ground electrode 5, which can facilitate ensuring various choices in materials of the ground protrusion 51 without limitation to specific materials and can restrain the cost rise.

As above, a spark plug can thus be provided that can prevent occurrence of the root migrations of discharge sparks to thereby prevent electrode wear.

First Experimental Example

A first experimental example will now be explained with reference to FIG. 4, where a rate of occurrence of the root migrations of discharge sparks in the spark plug 1 of the first embodiment was demonstrated using a high-flow spark discharge bench for various protrusion heights H of the ground protrusion 51 and widthwise dimensions W of the ground base member 50 and various curvature radii R of the base member corner 502. In the present experimental example, like numbers refer to like elements as in the first embodiment unless explicitly stated otherwise herein.

More specifically, the spark plugs were prepared for the total of 48 combinations of the protrusion height H of the ground protrusion 51, the widthwise dimension W of the ground base member 50, and the curvature radius R of the base member corner 502, where the protrusion height H of the ground protrusion 51 is selected from a group of 0.6 mm, 0.8 mm, 1.0 mm, and 1.2 mm, the widthwise dimension W of the ground base member 50 is selected from a group of 2.4 mm, 2.6 mm, 2.8 mm, and 3.0 mm, and the curvature radius R of the base member corner 502 is selected from a group of 0.1 mm, 0.25 mm, and 0.4 mm. The diameter D of the ground protrusion 51 was fixed at 1.0 mm. The diameter of the noble metal tip 21 of the central electrode 2 was fixed at 0.7 mm, and the axial height of the noble metal tip 21 of the central electrode 2 was fixed at 0.6 mm. The spark gap 11 was fixed at 1.1 mm. The angle θ can be derived uniquely from these values H, W, D. The ground protrusion 51 was made of a Pt-20 wt % Rh alloy and the noble metal tip 21 of the central electrode 2 was made of an Ir-10 wt % Rh alloy.

For each of the above 48 spark plugs installed in the high-flow spark discharge bench, a discharge test was conducted under a test condition that, given a high flow rate engine, an air flow rate in the high-flow spark discharge bench is set at 35 m/s, the air pressure is set at 0.9 MPa, and the atmosphere in the high-flow spark discharge bench is comprised of nitrogen. A high-voltage was applied to each spark plug via the ignition coil, where the coil energy of the ignition coil was set at 95 mA. Images of discharge sparks generated upon the voltage applications were captured using a high speed camera. A rate of occurrence of the root migrations of discharge sparks were thereby measured. The rate of occurrence of the root migrations of discharge sparks is a probability expressed as a number of times the root migrations of discharge sparks have occurred within 100 spark discharges observed.

Figure 4:
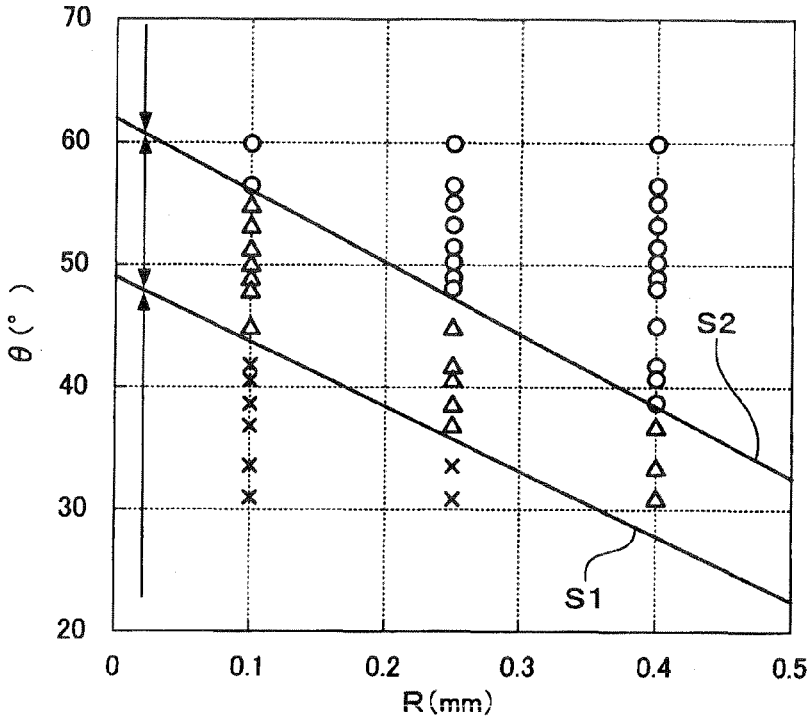
FIG. 4 is a diagram illustrative of an evaluation result of a rate of occurrence of root migrations of discharge sparks in a first experimental example.

FIG. 4 shows the observations, where the horizontal axis represents the curvature radius R [mm] of the base member corner 502 and the vertical axis represents the angle θ [degrees]. For each spark plug, a point of the curvature radius R [mm] and the angle θ [degrees] was plotted in the graph of FIG. 4, in which each circular symbol represents the root migration occurrence rate of zero %, each triangular symbol represents the root migration occurrence rate of less than 40%, and each x-symbol represents the root migration occurrence rate of 40% or more. In the present experimental example, however, it seems that only 45 points are plotted in the graph due to three point data overlapping.

In FIG. 4, the lines 1 and 2 are defined by the equations $\theta=-53R+49$ and $\theta=-59R+62$, respectively.

As can be seen from FIG. 4, only the circular and triangular symbols are plotted in the region on or above the line S1, that is, the region in which the inequality (1) is satisfied. No x-symbols are plotted in this region. The x-symbols are plotted only in the region below the line S1. The presence of such a region satisfying inequality (1) ensures the root migration occurrence rate of less than 40%, which can sufficiently prevent the root migrations of discharge sparks.

In addition, in FIG. 4, only the circular symbols are plotted in the region on and above the line S2, that is, the presence of such a region satisfying inequality (2) within the region on or above the line S1 ensures the root migration occurrence rate of 0%, which can reliably prevent the root migrations of discharge sparks.

A discharge test was also conducted for each of the spark plugs for combinations of the protrusion height H of the ground protrusion 51, the widthwise dimension W of the ground base member 50, and the diameter D of the ground protrusion 51, where the protrusion height H of the ground protrusion 51 is set at 0.6 mm, the widthwise dimension W of the ground base member 50 is set at 3.0 mm, and the diameter D of the ground protrusion 51 is selected from a group of 0.9 mm, 1.1 mm, and 1.4 mm, and for each spark plugs for combinations of the protrusion height H of the ground protrusion 51, the widthwise dimension W of the ground base member 50, and the diameter D of the ground protrusion 51, where the protrusion height H of the ground protrusion 51 is set at 1.0 mm, the widthwise dimension W of the ground base member 50 is set at 2.6 mm, and the diameter D of the ground protrusion 51 is selected from a group of 0.9 mm, 1.1 mm, and 1.4 mm under the similar test condition as above. It has been found (but not shown) that, for the spark plugs to be plotted in the region below the line S2, the root migration occurrence rate is equal to or greater than 40%, and for the spark plugs to be plotted in the region on or above the line S1, the root migration occurrence rate is 0%. Therefore, for various diameters D of the ground protrusion 51, the region satisfying the inequality (1) can sufficiently prevent the root migrations of discharge sparks, and particularly, the region satisfying the inequality (2) can reliably prevent the root migrations of discharge sparks.

Second Experimental Example

A second experimental example will now be explained with reference to FIG. 5, where a wear volume of the ground electrode and a frequency of re-discharges are evaluated.

The spark plugs used in the present experimental example are similar as in the first experimental example. In the present example, the diameter D of the ground protrusion 51 is fixed at 1.0 mm, the diameter of the noble metal tip 21 of the central electrode 2 is fixed at 0.7 mm, the axial height is fixed at 0.6 mm, and the spark gap 11 is fixed at 1.1 mm. In the present experimental example, like numbers refer to like elements as in the first embodiment unless explicitly stated otherwise herein.

The protrusion height H of the ground protrusion 51, the widthwise dimension W of the ground base member 50, and the curvature radius R of the base member corner 502 were set as follows. The spark plugs were prepared for samples 1, 2 and 3. The sample 1 was specified such that H=1.2 mm, W=2.4 mm, R=0.4 mm. The sample 2 was specified such that H=0.8 mm, W=2.6 mm, R=0.25 mm. The sample 3 was specified such that H=0.6 mm, W=3.0 mm, R=0.1 mm. The samplel satisfies the inequalities (1) and (2). The sample 2 satisfies the inequality (1), but doesn't satisfy the inequality (2). The sample 3 doesn't satisfy the inequality (1). The ground protrusion 51 was made of a Pt-20 wt % Rh alloy and the noble metal tip 21 of the central electrode 2 was made of an Ir-10 wt % Rh alloy.

For each of these three samples installed in the similar high-flow spark discharge bench as used in the first experimental example, an endurance test was conducted, where a high-voltage of about 20-25 kV was applied between the central electrode 2 and the ground electrode 5 at a frequency of 60 Hz for 300 hours to repeat discharges.

The after-endurance wear volume of the ground protrusion 51 was measured. In addition, during the endurance test, images of discharge sparks generated upon the voltage applications were captured using a high speed camera, and a number of re-discharges was counted for each discharge. During one discharge, blowing out of the discharge spark and re-discharge are repeated. The average number of re-discharges over the 100 discharges was calculated, where one discharge refers to one pulse of the pulsed voltage applied to the spark plug. The counting of the number of re-discharges is performed immediately after initiation of the endurance test.

Figure 5:
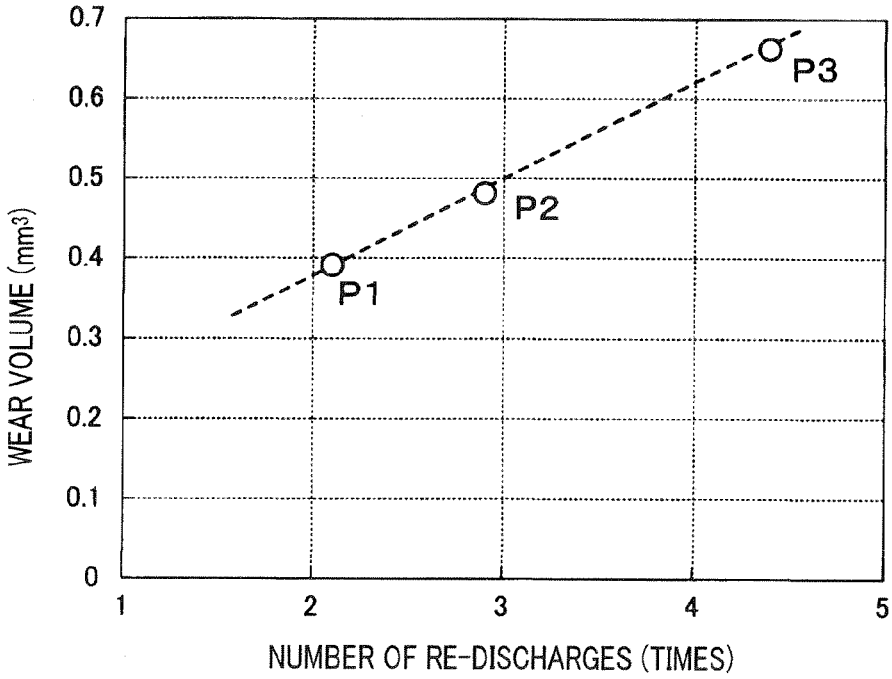
FIG. 5 is a diagram illustrative of an evaluation result of a wear volume of a ground protrusion and a number of re-discharges in a second experimental example.

FIG. 5 shows the wear volume of the ground protrusion and the number of re-discharges plotted for each of the samples 1, 2 and 3 as P1, P2 and P3, respectively. The horizontal axis represents the number of re-discharges and the vertical axis represents the wear volume [$mm^3$] of the ground protrusion. As can be seen from FIG. 5, the sample 3 that doesn't satisfy inequality (1) exhibits a larger wear volume of the ground protrusion while the sample 1 that satisfy both the inequalities (1) and (2) exhibits a smaller wear volume of the ground protrusion. Thus the sample 1 can suppress the wear volume of the ground protrusion. It can be seen that the wear volume of the ground protrusion increases with an increasing number of re-discharges.

Second Embodiment

A second embodiment of the present invention will now be explained with reference to FIGS. 6-8. Only differences of the second embodiment from the first embodiment will be explained. In the present embodiment, various shapes other than substantially rectangular shape as described above in the first embodiment may be employed as the cross-section shape of the ground base member 50 perpendicular to the axial direction of the ground base member 50.

Figure 6:
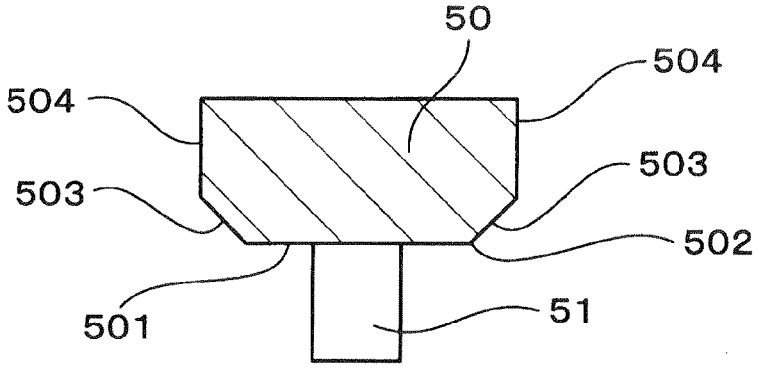
FIG. 6 is a cross-sectional view of a ground electrode such that a ground base member has inclined faces and is tapered in cross-sectional shape in accordance with a second embodiment of the present invention.

As a first example, as shown in FIG. 6, the ground base member 50 may include faces 503 inclined so as to define a tapered cross-section of the ground base member 50, each of which connects one of side faces 504 that are widthwise end faces and the confronting face 501. In such a configuration, each base member corner 502 may be defined as a corner between the confronting face 501 and one of the inclined faces 503. For each base member corner 502, the angle θ and the curvature radius R of the corner 502 satisfy the above set forth inequality (1), preferably, the inequality (2).

Figure 7:
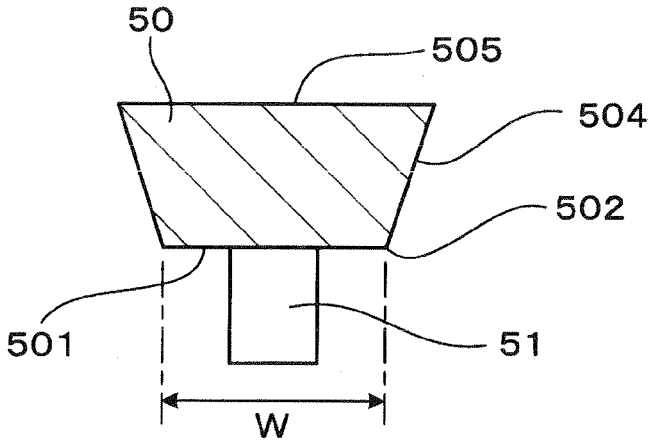
FIG. 7 is a cross-sectional view of a ground electrode such that a ground base member is trapezoidal in cross-sectional shape of the second embodiment.

As a second example, as shown in FIG. 7, the ground base member 50 may be substantially trapezoidal in cross-section shape such that a widthwise dimension W of the confronting face 501 is less than a widthwise dimension of its opposite back face 505 and each inclined face 504 connects the confronting face 501 and the back face 505.

Figure 8:
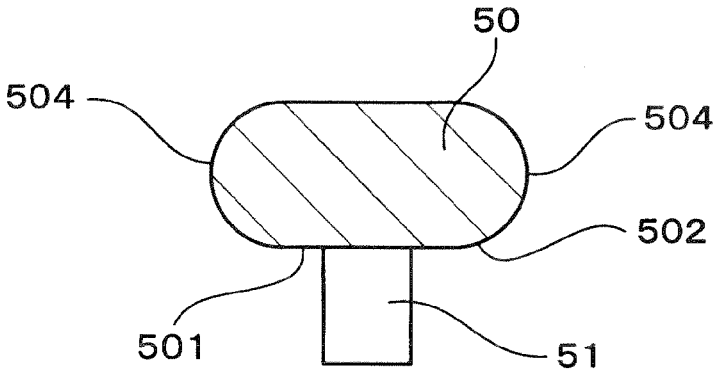
FIG. 8 is a cross-sectional view of a ground electrode such that a ground base member is oval in cross-sectional shape of the second embodiment.

As a third example, as shown in FIG. 8, the ground base member 50 may be substantially oval in cross-section shape such that the side faces 504 are arc-like in cross-section shape. In such an example, each transition portion from the confronting (flat) face 501 to one of the side faces 504 may be defined as the base member corner 502.

In some other examples, various shapes other than these shapes as shown in FIGS. 6-8 may be employed as the cross-section shape of the ground base member 50.

What is claimed is:

1. A spark plug for an internal-combustion engine, comprising:

a central electrode;

an insulator that holds the central electrode inside;

a housing that holds the insulator inside;

a ground electrode that forms a spark gap with the central electrode, the ground electrode including a ground base member connected to the housing, and a ground protrusion protruding from a confronting face of the ground base member confronting the central electrode, the ground protrusion having a diameter of 0.9 to 1.4 mm, the spark plug being configured to satisfy the following inequality:

$$\theta \geq -53R+49 \quad (1)$$

wherein R [mm] is a curvature radius of a base member corner and θ[degrees] is an angle formed by a shortest connecting line between the base member corner and a protrusion corner and a plane perpendicular to an axial direction of the ground protrusion, the base member corner being a widthwise directional edge of the confronting face of the ground base member and the protrusion corner being an edge of a spark face of the ground protrusion confronting the central electrode.

2. The spark plug of claim 1, wherein the angle θ and the curvature radius R satisfy the following inequality:

$$\theta \geq -59R+62 \quad (2).$$

3. The spark plug of claim 1, wherein the ground protrusion has a protrusion height of 0.6 to 1.2 mm from the ground base member.

4. The spark plug of claim 1, wherein the ground base member has a dimension of 2.4 to 3.0 mm in a widthwise direction that is perpendicular both to a longitudinal direction of the ground base member and to an axial direction of the ground protrusion.

5. The spark plug of claim 1, wherein the base member corner has a curvature radius of 0.1 to 0.4 mm.

6. The spark plug of claim 1, wherein the ground base member has a substantially rectangular cross-section perpendicular to an axial direction of the ground base member.

7. The spark plug of claim 6, wherein the base member corner is a widthwise directional edge of the confronting face of the ground base member.

8. The spark plug of claim 7, wherein the ground base member is chamfered to be curved with the curvature radius R at the base member corner.

9. The spark plug of claim 1, wherein the ground base member is tapered toward the central electrode in cross-section shape.

10. The spark plug of claim 1, wherein the ground base member has a substantially trapezoidal cross-section perpendicular to an axial direction of the ground base member.

11. The spark plug of claim 1, wherein the ground base member is substantially oval cross-section perpendicular to an axial direction of the ground base member.

* * * * *